US007765969B2

(12) United States Patent
Takada et al.

(10) Patent No.: US 7,765,969 B2
(45) Date of Patent: Aug. 3, 2010

(54) VERTICAL INTERNAL COMBUSTION ENGINE PROVIDED WITH BELT-DRIVE TRANSMISSION MECHANISM

(75) Inventors: Hideaki Takada, Wako (JP); Yutaka Kubota, Wako (JP); Tatsuya Kuroda, Wako (JP); Kazutake Koyama, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 355 days.

(21) Appl. No.: 11/809,874

(22) Filed: Jun. 1, 2007

(65) Prior Publication Data

US 2007/0277762 A1 Dec. 6, 2007

(30) Foreign Application Priority Data

Jun. 5, 2006 (JP) ..... 2006-156680

(51) Int. Cl.
*F01L 1/02* (2006.01)

(52) U.S. Cl. ..... 123/90.31; 123/90.33

(58) Field of Classification Search ..... 123/90.31, 123/90.33, 90.38
See application file for complete search history.

(56) References Cited

U.S. PATENT DOCUMENTS 5,989,084 A * 11/1999 Tsunoda et al. ..... 440/49
6,302,749 B1 * 10/2001 Tawa et al. ..... 440/76
2005/0005894 A1 * 1/2005 Fukuda et al. ..... 123/196 W

FOREIGN PATENT DOCUMENTS

JP 02-275020 11/1990

* cited by examiner

*Primary Examiner*—Zelalem Eshete
(74) *Attorney, Agent, or Firm*—Carrier, Blackman & Associates, P.C.; William D. Blackman; Joseph P. Carrier

(57) ABSTRACT

A vertical internal combustion engine E has a crankshaft 18 enclosed in a crank chamber 20, a belt-drive transmission mechanism 50 held in a belt chamber 63 and including a rubber belt 53 for transmitting power of the crankshaft 18 to a camshaft 24 in a valve train 23, and a transmission case 60 defining the belt chamber 63. The belt chamber 63 communicates with the crank chamber 20 by way of vent holes 70 and 71, the transmission case 60 is provided with an internal wall $W_i$ disposed between the vent holes 70 and 71 and the belt 53 in the belt chamber 63 to deflect the flow of an oil-containing gas flowing from the crank chamber 20 into the belt chamber 63 such that the oil-containing gas flows in directions deviating from a direction toward the belt 53. The belt 53 is lubricated with oil in the oil-containing gas. The belt 53 is prevented from being excessively exposed to the oil-containing gas from the crank chamber 20 to extend its life.

18 Claims, 6 Drawing Sheets

VERTICAL INTERNAL COMBUSTION ENGINE PROVIDED WITH BELT-DRIVE TRANSMISSION MECHANISM

BACKGROUND OF THE INVENTION

1. Field of the Invention

The present invention relates to a vertical internal combustion engine having a crankshaft held in a crankcase with its center axis vertically extended, and provided with a belt-drive transmission mechanism including a lubricated rubber belt for transmitting the power of the crankshaft to a driven device. The vertical internal combustion engine is incorporated into, for example, an outboard motor.

2. Description of the Related Art

A vertical internal combustion engine disclosed in, for example, JP-A 2-275020 is provided with a belt-drive transmission mechanism including a rubber belt for transmitting the power of the crankshaft to a driven device. The belt-drive transmission mechanism is placed in a belt chamber, and the rubber belt is lubricated with oil that flows from the crankcase into the belt chamber.

If the belt chamber is opened into the crankcase and the components of the belt-drive transmission mechanism including a belt and pulleys are exposed to the atmosphere in the crankcase, the belt is likely to be exposed to gas containing oil mist and blowby gases. Hereinafter, this gas will be referred to as "oil-containing gas". Moreover, the belt is wetted with oil drops splashed by the rotating crankshaft and with the oil adhered to the pulleys and scattered when the pulleys rotate. Consequently, the belt is excessively lubricated. If the belt is exposed excessively to the oil and blowby gases contained in the oil-containing gas and to the high-temperature oil-containing gas, components of the oil and the blowby gases accelerate the degradation of the rubber belt and shorten the life of the rubber belt. If the width and thickness of the belt is increased and the strength of the belt is enhanced to reduce the detrimental effect of degradation on the belt, the cost and size of the belt-drive transmission mechanism increase. If the belt is not satisfactorily lubricated, the belt is abraded by increased friction between the belt and the pulley and the life of the belt shortens.

SUMMARY OF THE INVENTION

The present invention has been made in view of those problems and it is therefore an object of the present invention to extend the life of a rubber belt included in a transmission mechanism incorporated into a vertical internal combustion engine by preventing the rubber belt from being excessively exposed to oil-containing gas from the crankcase of the vertical internal combustion engine. Another object of the present invention is to suppress contact between the rubber belt and oil collected on a bottom wall of the belt chamber.

To achieve the object, the present invention provides a vertical internal combustion engine comprising: a crankshaft enclosed in a crank chamber with a center axis thereof vertically extended; a driven mechanism including a driven shaft rotatively driven by the crankshaft; a belt-drive transmission mechanism held in a belt chamber and including a belt made of rubber for transmitting power of the crankshaft to the driven shaft and lubricated with oil; and a transmission case defining the belt chamber; wherein the belt chamber communicates with the crank chamber by way of vent holes, the transmission case is provided with a barrier member disposed between the vent holes and the belt in the belt chamber so as to deflect a flow of an oil-containing gas flowing from the crank chamber into the belt chamber such that the oil-containing gas flows in directions deviating from a direction toward the belt.

According to the present invention, the oil-containing gas flowing from the crankcase through the vent holes into the belt chamber is deflected from a direction toward the belt. Consequently, the oil-containing gas, as compared with an oil-containing gas that flows directly toward the belt, is less likely to come into contact with the belt. Since the temperature of the oil-containing gas drops, the degradation of the belt resulting from contact with the oil and blowby gases contained in the oil-containing gas can be suppressed. Lubrication of the belt with the oil contained in the oil-containing gas can extend the life of the belt and maintenance interval.

In a practical example of the present invention, the vent is formed in the bottom wall of the belt chamber, a first part, extending immediately under the belt, of the inside surface of the bottom wall exposed to the belt chamber is at a high level higher than a low level at which a second part, extending from the first part to the vent, of the inside surface of the bottom wall.

Oil contained in the oil-containing gas separates from the oil-containing gas when the oil-containing gas flows against the barrier member. Then, the oil separated from the oil-containing gas flows along the second part at the low level below the first part at the high level extending immediately under the belt and flows out of the belt chamber through the vent. Thus the degradation of the belt is suppressed and the life of the belt is extended because the belt is restrained from touching the oil collected on the inside surface of the bottom wall of the belt chamber.

In a practical example of the present invention, the belt chamber has a top wall, and the barrier member extends between the bottom wall and the top wall, has a height equal to the distance between bottom wall and the top wall and extends horizontally so as to surround the belt substantially entirely.

The barrier wall in the shape of a circumferential wall has a height equal to that of the belt chamber and surrounds the belt substantially entirely. Thus the belt is prevented effectively from excessive exposure to the oil-containing gas.

DESCRIPTION OF THE PREFERRED EMBODIMENTS

FIGS. 1 to 5 illustrate a vertical internal combustion engine E in a first embodiment of the present invention.

Figure 1:
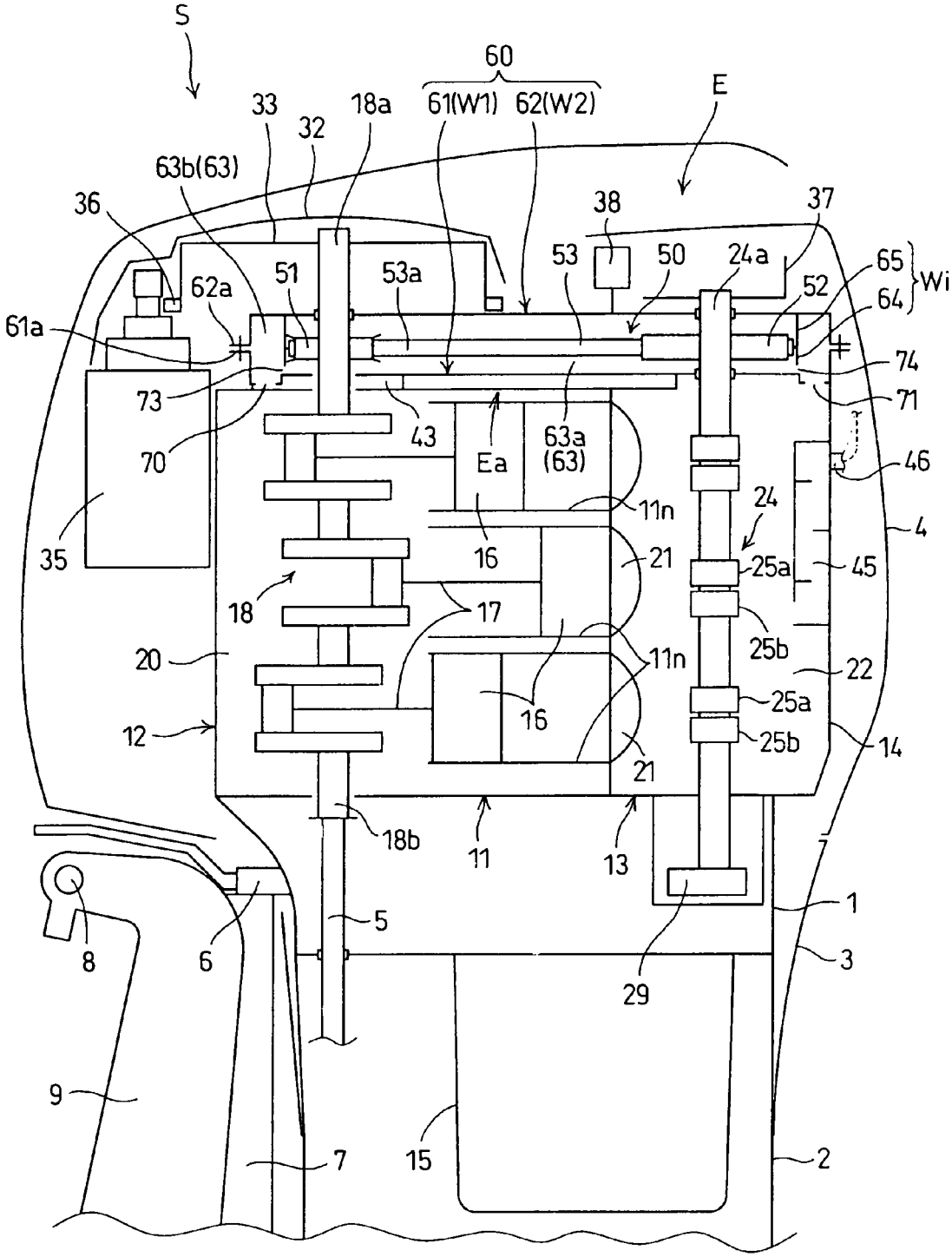
FIG. 1 is a schematic side elevation of an outboard motor provided with a vertical internal combustion engine in a first embodiment of the present invention taken from the left side of the outboard motor.

Referring to FIG. 1, the vertical internal combustion engine E is incorporated into an outboard motor S. The outboard motor S includes the internal combustion engine E disposed with the center axis of its crankshaft 18 vertically extended, a mount case 1 supporting the internal combustion engine E, an extension case 2 joined to the lower end of the mount case 1, a gear case joined to the lower end of the extension case 2, an under cover 3 covering a part between a lower part of the internal combustion engine E and an upper part of the extension case 2, and an engine cover 4 joined to the upper end of the under cover 3.

The outboard motor S has a transmission mechanism including a drive shaft 5 coaxially connected to a lower end part 18*b* of the crankshaft 18, a reversing mechanism held in the gear case, and a propeller. The power of the internal combustion engine E is transmitted from the crankshaft 18 through the drive shaft 5 and the reversing mechanism to the propeller.

A mounting device for mounting the outboard motor S on the stern of a hull has a swivel shaft 6 fixed to the mount case 1 and the extension case 2, a swivel case 7 supporting the swivel shaft 6 for turning thereon, a tilting shaft 8 supporting the swivel case 7 so as to be turnable in a vertical plane, and a bracket 9 holding the tilting shaft 8 and attached to the stem of the hull. The mounting device holds the outboard motor S so as to be turnable on the tilting shaft 8 in a vertical plane relative to the hull and so as to be turnable on the swivel shaft 6 in a horizontal plane.

Figure 2:
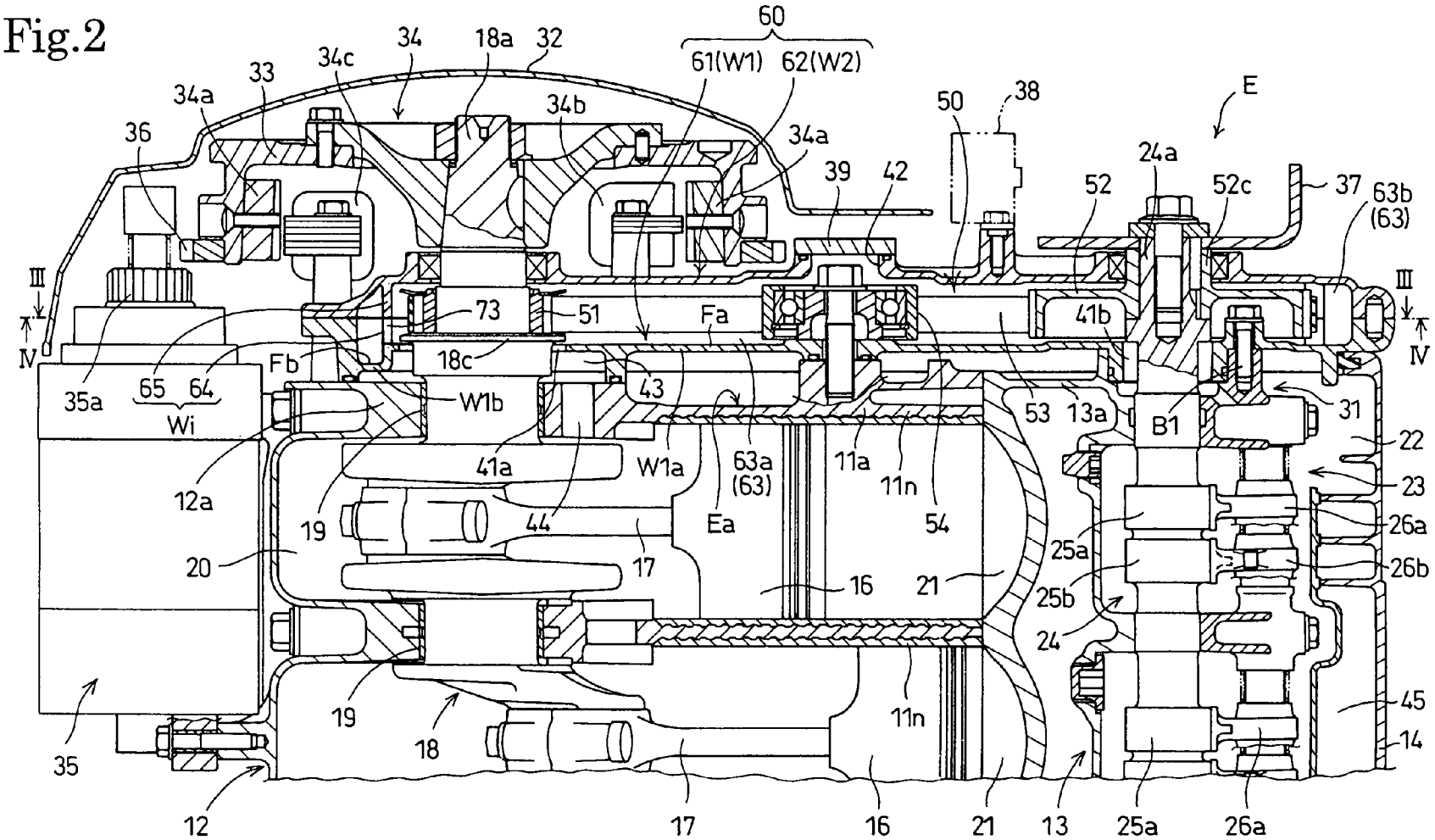
FIG. 2 is an enlarged sectional view of an essential part of the vertical internal combustion engine shown in FIG. 1.

Referring to FIGS. 1 and 2, the internal combustion engine E, which is a multi-cylinder 4-stroke internal combustion engine, has an engine body including a cylinder block 11 provided with three cylinders 11*n* arranged in a row in a vertical direction, a crankcase 12 joined to the front end of the cylinder block 11, a cylinder head 13 joined to the rear end of the cylinder block 11, and a head cover 14 joined to the rear end of the cylinder head 13, and an oil pan 15 placed in the extension case 2 and joined to the lower end of the mount case 1.

Pistons 16 are fitted in the cylinders 11*n* for reciprocation in the cylinders 11*n*, respectively. The pistons 16 are connected by connecting rods 17, respectively, to the crankshaft 18 placed in a crank chamber 20 defined by the cylinder block 11 and the crank-case 12. The vertical crankshaft 18 is supported for rotation in main bearings 19 on the cylinder block 11 and the crankcase 12 with its center axis extended substantially parallel to a vertical direction.

The cylinder head 13 is provided with combustion chambers 21 respectively opposed to the pistons 16 with respect to a direction parallel to the axes of the cylinders 11*n*, intake ports respectively opening into the combustion chambers 21, exhaust ports respectively opening into the combustion chambers 21, and spark plugs respectively facing the combustion chambers 21. The cylinder head 13 is provided with intake valves for opening and closing the intake ports, and exhaust valves for opening and closing the exhaust ports. The intake valves and the exhaust valves are driven for opening and closing operations in synchronism with the rotation of the crankshaft 18 by an overhead camshaft type valve train 23 disposed in a valve train chamber 22 defined by the cylinder head 13 and the head cover 14.

The valve train 23 includes a camshaft 24 provided with intake cams 25*a* and exhaust cams 25*b*, intake rocker arms 26*a* supported for rocking motions on a rocker arm shaft, and exhaust rocker arms 26*b* supported for rocking motions on a rocker arm shaft. The camshaft 24 is driven for rotation by the crankshaft 18 through a belt-drive transmission mechanism 50. The camshaft 24 has a center axis parallel to that of the vertical crankshaft 18. The intake valves and the exhaust valves are driven for opening and closing motions by the intake rocker arms 26*a* and the exhaust rocker arms 26*b* driven by the intake cams 25*a* and the exhaust cams 25*b*, respectively. The valve train 23 is a driven device provided with the camshaft 24, namely, a driven shaft, driven for rotation by the crankshaft 18.

Figure 3:
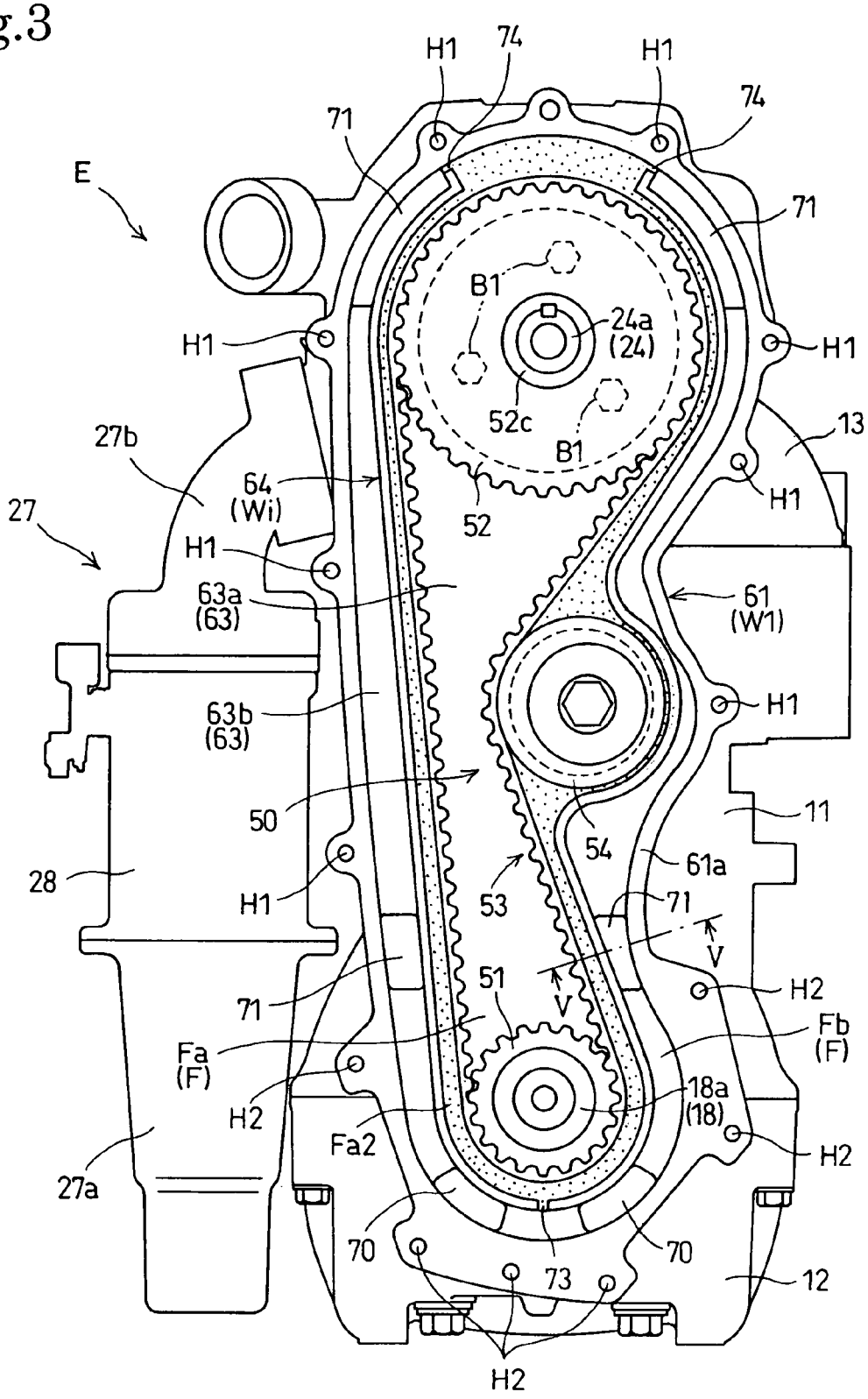
FIG. 3 is a sectional view taken on the line III-III in FIG. 2.
Figure 4:
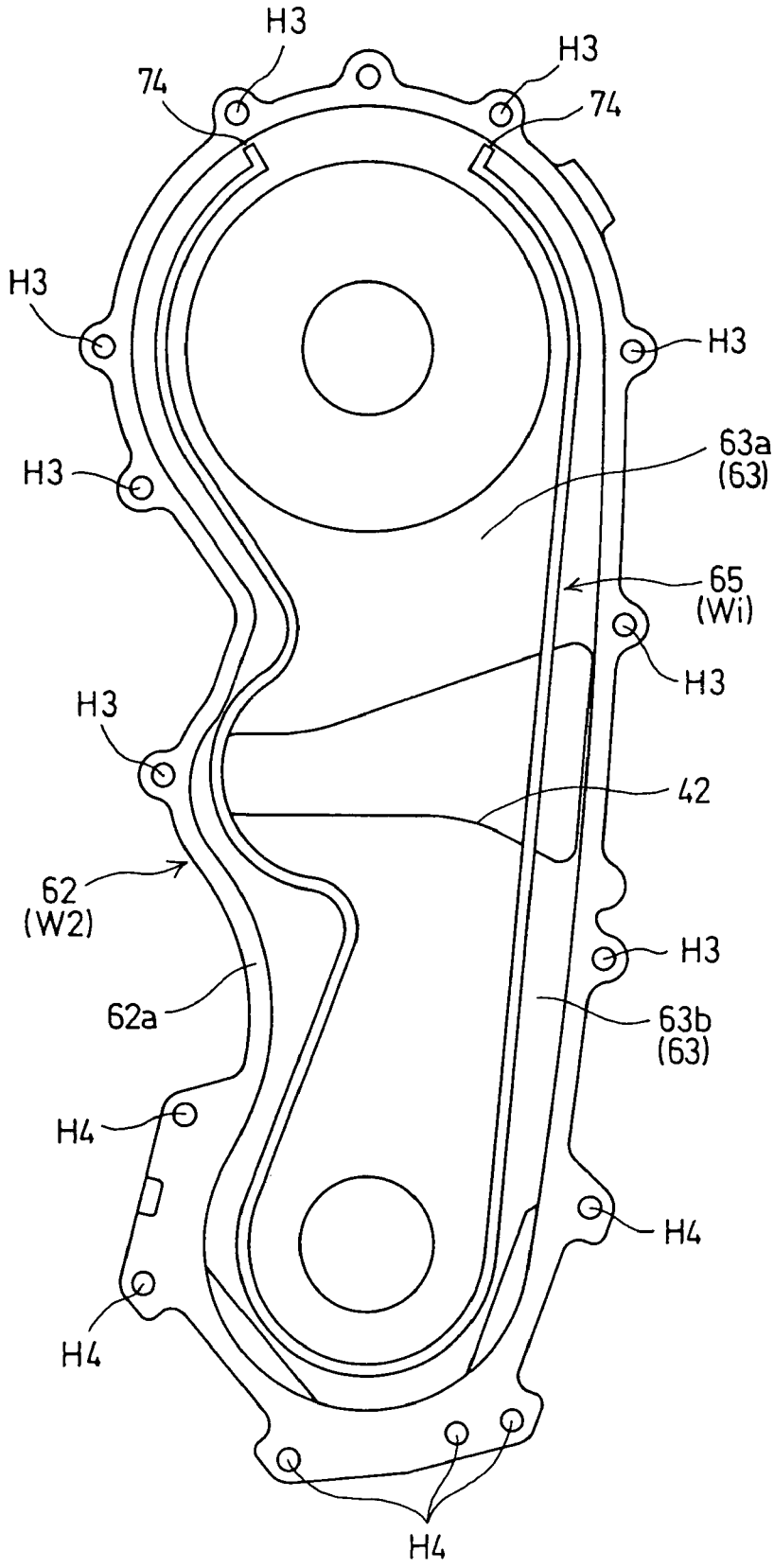
FIG. 4 is a sectional view taken on the line IV-IV in FIG. 2.

Referring also to FIG. 3, the internal combustion engine E has an intake system 27 including an inlet air silencer 27*a*, and an intake pipe 27*b* for carrying intake air taken in through the inlet air silencer 27*a* and metered by a throttle valve included in a carburetor 28 to the intake ports. The intake air that flows through an intake passage in the intake system 27 is mixed with fuel in a carburetor 28 for each cylinder 11*n* to produce an air-fuel mixture. The air-fuel mixture is sucked through the intake pipe 27*b* and the intake port into the combustion chamber 21. Then, the air-fuel mixture is ignited by the spark plug and burns to produce a combustion gas. Thus the pistons 16 are reciprocated by the pressure of the combustion gas and drive the crankshaft 18 for rotation through the connecting rods 17.

The combustion gas discharged as exhaust gas from the combustion chambers 21 flows through the exhaust ports into an exhaust manifold passage formed in the cylinder block 11. Then, the exhaust gas is discharged through passages formed in the mount case 1, the exhaust pipe and the extension case 2 into the water.

The internal combustion engine E is provided with a lubrication system including the oil pan 15 placed below the cylinder block 11, the cylinder head 13 and the crankcase 12, an oil pump 29 (FIG. 1) driven by the camshaft 24 supported on the cylinder head 13, and oil passages. The oil pump 29 pumps up oil through a suction oil passage formed in the mount case 1, the cylinder block 11 and the cylinder head 13 from the oil pan 15. The oil discharged from the oil pump 29 flows through a discharge oil passage formed in the cylinder head 13 and the cylinder block 11 and an oil filter into a main oil gallery. The oil that has flowed into the main oil gallery is distributed through oil passages formed in the cylinder block 11, the cylinder head 13 and the crankshaft 18 to parts requiring lubrication including moving parts of the crankshaft 18 and the main bearings 19 in the crank chamber 20, and moving parts of the valve train 23 including the camshaft 24 and the rocker arms 26*a* and 26*b* in the valve train chamber 22. The used oil flows through return passages formed in the cylinder block 11, the cylinder head 13 and the mount case 1 and returns to the oil pan 15.

Referring to FIG. 2, the belt-drive transmission mechanism 50 is disposed in a belt chamber 63 defined by a transmission case 60 included in the internal combustion engine E. The transmission case 60 has a lower case 61, namely, a first case, joined to the upper end $E_a$ of the engine body, and an upper case 62, namely, a second case, joined to the lower case 61. The lower case 61 forms a bottom wall W1, namely, a first wall, and the upper case 62 forms a top wall W2, namely, a second wall. The bottom wall W1 and the top wall W2 defines the belt chamber 63. The respective flanges 61*a* (FIG. 3) and 62*a* (FIG. 4) of the lower case 61 and the upper case 62 are joined together in an oil-tight fashion with bolts not shown, passed through through holes H3 (FIG. 4) formed in the upper case 762 and screwed into threaded holes H1 (FIG. 3) formed in the lower case 61, and bolts, not shown, passed through through holes H4 formed in the upper case 62 and through holes H2 formed in the lower case 61 and screwed into threaded holes formed in respective upper end parts 11*a* and 12*a* (FIG. 2) of the cylinder block 11 and the crankcase 12. The lower case 61 is fastened to an upper end part 13*a* of the cylinder head 13 with bolts B1 and connected to the upper end part 13*a* by a camshaft holder 31. The upper end parts 11*a*,

12*a* and 13*a* form an upper end part $E_a$ of the engine body. The bottom wall W1 and the top wall W2 define the belt chamber 63.

The belt-drive transmission mechanism 50 includes a drive pulley 51, a driven pulley 52, a belt 53 made of rubber, namely, an endless toothed belt, and a tension pulley 54 (FIG. 3). The drive pulley 51 is mounted in the belt chamber 63 on an upper end part 18*a* of the crankshaft 18 extended vertically upward through the lower case 61 and the upper case 62. The driven pulley 52 is mounted in the belt chamber 63 on an upper end part 24*a* of the camshaft 24 extended vertically upward through the lower case 61 and the upper case 62. The belt 53 is extended between the drive pulley 51 and the driven pulley 52 and is tensioned by the tension pulley 54.

Referring to FIGS. 1 and 2, a part of the upper end part 18*a* projected upward from the upper case 62 is covered with a cover 32 attached to the upper case 61. An AC generator 34 is disposed in a space covered with the corer 32. The AC generator 34 includes a flywheel 33, permanent magnets 34*a* attached to the flywheel 33, an exciter coil 34*b* for ignition fixedly held on the upper end $E_a$ of the engine body, and a charging coil 34*c*. A ring gear 36 is attached to the circumference of the flywheel 33. A pinion 35*a* mounted on the drive shaft of a starting motor 35 is brought into mesh with the ring gear 36. A pulser rotor 37 is mounted on the upper end part 24*a* of the camshaft 24. A pulser coil 38 for generating a pulse signal indicating an angular position of the camshaft 24 is attached to the upper case 62.

The upper case 62 is provided with openings through which the upper end parts 18*a* and 24*a* and the boss 52*c* of the driven pulley 52 are extended, and a hand hole 42 for adjusting the position of the tension pulley 54. The hand hole 42 is covered with a cover 39. Joints between the upper end parts 18*a* and 24*a* and the boss 52*c* and the openings are sealed in an oil-tight fashion.

Referring to FIGS. 2 and 3, the lower case 61 disposed between the crank chamber 20 and the belt chamber 63 with respect to the vertical direction is provided with opening 41*a* and 41*b* through which the upper end parts 18*a* and 24*a* are passed, respectively, crank chamber vent holes 70 opening into the crank chamber 20, and valve train chamber vent holes 71 opening into the valve train chamber 22. The vent holes 70 open into a space 43 between the lower case 61 and the respective upper end parts 11*a* and 12*a* of the cylinder block 11 and the crankcase 12. The vent holes 70 communicate with the crank chamber 20 by way of a connecting passage 44 formed in the upper end 11*a*. A part of the lower case 61 around the opening 41*a* is joined to the cylinder block 11 and the crankcase 12 in an oil-tight fashion. A part of the lower case 61 around the opening 41*b* is joined to the cylinder head 13 and the camshaft holder 31 in an oil-tight fashion.

The circular opening 41*a* is slightly greater than a circular flange 18*c* formed on the upper end part 18*a* of the crankshaft 18. Therefore, the flow of the gas between the crank chamber 20 and the belt chamber 63 through the opening 41*a* is very small and negligible as compared with the flow of the gas through the vent holes 70 and 71. Thus the gas flows between the crank chamber 20 and the belt chamber 63 substantially only through the vent holes 70, and the gas flows between the valve train chamber 22 and the belt chamber 63 substantially only through the vent holes 71.

The vent holes 70 and 71 lie below the belt 53. Suppose that the belt chamber 53 is divided into an inside area surrounded by the belt 53 and an outside area extending outside the belt 53 in a horizontal plane. The vent holes 70 and 71 are formed in the outside area, namely, an area extending between the belt-drive transmission mechanism 50 and the flange 61*a*. Therefore, the vent holes 70 and 71 do not overlap the belt-drive transmission mechanism 50 in a horizontal plane. Thus the lower case 61 serves as a shielding member or a partition wall entirely or substantially entirely isolating an overlying part of the belt-drive transmission mechanism 50 overlying the crank chamber 20 from the crank chamber 20 as viewed in a vertical direction or in a horizontal plane, and the vent holes 70 and 71 do not overlap the overlying part of the belt-drive transmission mechanism 50 corresponding to the crank chamber 20 as viewed in a horizontal plane. In this embodiment, the overlying part of the belt-drive transmission mechanism 50 includes at least a part 53*a* (FIG. 1) of the belt 53 overlying the crank chamber 20 in a plane containing the belt 53 among the components of the belt-drive transmission mechanism 50.

Referring to FIGS. 1 and 2, a breather structure for carrying blowby gases from the crank chamber 20 into the intake system 27 has a wall defining a breather chamber 45 in the valve train chamber 22, and a breather pipe 46 (FIG. 1) connecting the breather chamber 45 to the inlet air silencer 27*a*. The breather chamber 45 has an upstream part communicating with the valve train chamber 22, and a downstream part connected to the breather pipe 46. Blowby gases flow through the breather chamber 45 into the intake passage.

More concretely, the crank chamber 20 contains therein oil drips and oil mist produced from oil splashed by the rotating crankshaft 18 and oil discharged from the main bearings 19, and blowby gases. An oil-containing gas, namely, a mixture of blowby gases and oil mist, is drawn from the crank chamber 20 through internal breather passages, not shown, formed in the cylinder block 11 and the cylinder head 13 into the valve train chamber 22 by intake manifold vacuum created in the breather chamber 45 while the internal combustion engine E is running. In the meantime, part of the oil-containing gas flows from the crank chamber 20 through the connecting passage 44, the space 43 and the vent holes 70 into the belt chamber 63, and then flows from the belt chamber 63 through the vent holes 71 into the valve train chamber 22. Oil is separated from the oil-containing gas drawn into the valve train chamber 22 in the breather chamber 45 to produce a gas not containing oil. The gas not containing oil flows from the breather chamber 45 through the breather pipe 46 into the inlet air silencer 27*a*. Then, the gas is taken together with intake air into the combustion chambers 21.

The oil mist contained in the oil-containing gas that flows from the crank chamber 20 into the belt chamber 63 wets the components of the transmission mechanism 50 including the belt 53 and the pulleys 51 and 52 within the belt chamber 63. Thus the belt 53 and the pulleys 51 and 52 are lubricated. Oil drops scattered in the crank chamber 20 are blocked off by the lower case 61, so that the oil drops are restrained from adhering to the components of the transmission mechanism 50 including the belt 53.

The oil-containing gas flowing from the crank chamber 20 toward the belt chamber 63 hits against the lower case 61 in the space 43. Consequently, the flow of the oil-containing gas is deflected such that the oil-containing gas from the crank chamber 20 flows in directions deviating from a direction toward the belt chamber 63, and then flows through the vent holes 70 into the belt chamber 63. When the oil-containing gas hits against the lower case 61, part of the oil contained in the oil-containing gas separates from the oil-containing gas and adheres to the lower case 61, so that the oil content of the oil-containing gas is reduced.

Referring to FIGS. 1 to 4, the transmission case 60 is provided with an internal wall $W_i$ (FIGS. 3 and 4), namely, a barrier member, disposed in the belt chamber 63 so as to separate the transmission mechanism 50 from the vent holes 70 and 71. The internal wall $W_i$ is disposed to prevent the oil-containing gas that has flowed from the crank chamber 20 through the vent holes 70 into the belt chamber 63 from flowing toward the transmission mechanism 50 including the belt 53, the pulleys 51 and 52 and the tension pulley 54. Thus the belt chamber 63 isolated from the crank chamber 20 so that the flow of the oil-containing gas deviates from a direction toward the transmission mechanism 50 including the belt 53. The transmission case 60 and the internal wall $W_i$ serve as partition walls for isolating the belt chamber 63 from the crank chamber 20.

The internal wall $W_i$ surrounding the belt 53 has a height equal to the vertical distance between the bottom wall W1 and the top wall W2 defining the belt chamber 63. The internal wall $W_i$ surrounds the transmission mechanism 50 including the belt 53 substantially entirely in a horizontal plane. As shown in FIG. 2, the internal wall $W_i$ is formed by joining or abutting together the lower, internal side wall 64 of the lower case 61 and the upper internal side wall 65 of the upper case 62, which are substantially parallel to each other with respect to a vertical direction. The internal side walls 64 and 65 surround the transmission mechanism 50 including the belt 53, and the pulleys 51, 52 and 54 substantially entirely in a horizontal plane.

The belt chamber 63 is a dual chamber including an inner chamber 63*a* extending on the inner side of the internal wall $W_i$ and holding the entire transmission mechanism 50, and an outer chamber 63*b* into which the vent holes 70 and 71 open. The internal wall $W_i$ is provided with a plurality of connecting ports 73 and 74 (FIG. 3) by way of which the inner chamber 63*a* and the outer chamber 63*b* communicate with each other.

The crank chamber connecting port 73 is on the side of the crank chamber 20 with respect to a cylinder axis direction parallel to the axes of the cylinders 11*n*. The valve train chamber connecting ports 74 are on the side of the valve train chamber 22 with respect to the cylinder axis direction. The connecting port 73 is disposed between the two vent holes 70 near the belt 53. The connecting port 73 is a slit (FIG. 2) formed in the lower, internal side wall 64. The connecting ports 74 are disposed between the vent holes 71 near the belt 53. Each of the connecting ports 74 is formed by a pair of slits or cuts respectively formed in an end part of the lower, internal side wall 64 and an end part of the upper, internal side wall 65. The connecting port 73 and the connecting ports 74 are on the opposite sides of the arrangement of the belt 53 and the pulleys 51 and 52, respectively. The respective sectional areas of the connecting ports 73 and 74 are smaller than those of the vent holes 70 and 71. The sectional area of the connecting port 73 is determined so that the belt 53 may be properly lubricated with the oil contained in the oil-containing gas that flows through the connecting port 73 into the inner chamber 63*a*.

Part of the oil-containing gas deflected by the lower, internal side wall 64 and the upper, internal side wall 65 flows from the outer chamber 63*b* mainly through the connecting port 73 into the inner chamber 63*a*. Oil mist contained in the oil-containing gas wets the belt 53 and the pulleys 51 and 52 to lubricate the same.

Figure 5:
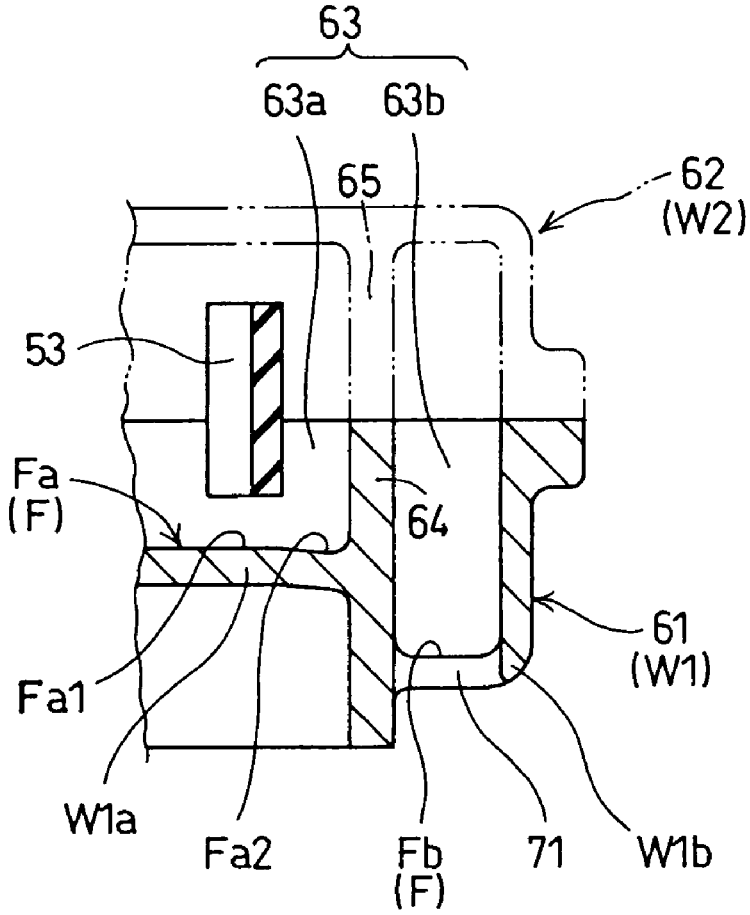
FIG. 5 is a sectional view taken on the line V-V in FIG. 3.

Referring to FIG. 5, an inside part W1*a* of the bottom wall W1 (or the lower case 61) forming the inner chamber 63*a* extends at a high level higher than a low level at which an outside part W1*b* extends. The outside part W1*b* is the bottom wall of a recess or a groove formed in the bottom wall W1. The vent holes 70 and 71 are formed in the bottom wall of the outside part W1*b*. An inner bottom surface $F_a$ of the inner chamber 63*a* including a first part $F_{a1}$ extending immediately below the belt 53 extends at a high level higher than a low level at which an outer bottom surface $F_b$ of the outer chamber 63*b* provided with the vent holes 71 and 72 extends. The first part $F_{a1}$ is at a high level higher than a low level at which a second part $F_{a2}$ extending from the first part $F_{a1}$ via the inner bottom surface $F_a$, the connecting ports 73 and 74 and the outer bottom surface $F_b$ to the vent holes 70 and 71. The second part $F_{a2}$ is part of the inner bottom surface $F_a$ excluding the first part $F_{a1}$ and the outer bottom surface $F_b$. In FIG. 3, dotted area is a portion of the second part $F_{a2}$ in the inner bottom surface $F_a$.

Oil collected on the inner bottom surface $F_a$ of the inner chamber 63*a* does not stay on the first part $F_{a1}$; the oil flows along the second part $F_{a2}$ of the inner bottom surface $F_a$, and flows through the connecting pores 73 and 74 into the outer chamber 63*b*. Then, the oil drops down through the vent holes 70 and 71 into the crank chamber 20 and the valve train chamber 22.

The operations and effects of the internal combustion engine E will be described.

The transmission case 60 forming the belt chamber 63 in the internal combustion engine E has the lower case 61 (or the bottom wall W1). The lower case 61 serves as a screening member for screening the belt chamber 63 from the crank chamber 20. The lower case 61 screens the part 53*a* (FIG. 1) of the belt 53 extending over the crank chamber 20 from the crank chamber 20. The lower case 61 screens the belt 53 from oil drops scattered out from the crank chamber 20 and oil-containing gas flowing out from the crank chamber 20. Thus the belt 53 is prevented from being excessively wetted with oil drops and oil mist contained in the oil-containing gas and from being excessively exposed to blowby gases contained in the oil-containing gas.

The lower case 61 of the transmission case 60 serves as a screening member. Therefore, the internal combustion engine E does not need any special screening member, which reduces the number of component parts and the cost of the internal combustion engine E.

The lower case 61 is provided with the vent holes 70 and 71 formed in the outside part W1*b* of the bottom wall W1 not overlapping the part 53*a* of the belt 53 extending over the crank chamber 20 in a horizontal plane. Therefore, the belt 53 is prevented from being excessively wetted with the oil contained in the oil-containing gas flowing through the vent holes 70 and 71 into the belt chamber 63. The belt 53 is lubricated properly with the oil contained in the oil-containing gas.

The belt chamber 63 formed in the transmission case 60 communicates with the crank chamber 20 by way of the vent holes 70 and 71. The transmission case 60 is provided in the belt chamber 63 with the internal wall $W_i$ separating the transmission mechanism 50 including the belt 53 from the vent holes 70 and 71. The internal wall $W_i$ deflects the flow of the oil containing gas flowing through the vent holes 70 and 71 into the belt chamber 63 such that the oil-containing gas flows in directions deviating from a direction toward the belt. Therefore, the belt 53 is exposed to the oil-containing gas less than the belt 53 is exposed to the oil-containing gas when the oil-containing gas flows through the vent hole 70 directly toward the belt 53, and the temperature of the oil-containing gas drops. Consequently, the life of the belt 53 lubricated with the oil contained in the oil-containing gas is extended, and maintenance interval can be extended.

The bent holes 70 and 71 are formed in the bottom wall W1 of the belt chamber 63. The first part $F_{a1}$ of the inside surface F of the bottom wall W1 extending in the belt chamber 63 extending immediately under the belt 53 is at the high level higher than the low level at which the second part $F_{a2}$ extending from the first part $F_{a1}$ to the vent holes 70 and 71 extends. Therefore, oil separated from the oil-containing gas when the oil-containing gas hits against the internal wall $W_i$ in the inner chamber 63*a* flows along the second part $F_{a2}$ at the low level lower than the first part $F_{a1}$ extending immediately under the belt 53 at the high level to the vent holes 70 and 71, and flows out from the belt chamber 63 through the vent holes 70 and 71. Thus the belt 53 is restrained from touching the oil collected on the inner bottom surface $F_a$. Consequently, the degradation of the belt 53 due to being wetted with the oil can be retarded and the life of the belt 53 can be extended.

The internal wall $W_i$ extends vertically between the bottom wall W1 and the top wall W2 of the belt chamber 63 and has a height equal to the vertical distance between the bottom wall W1 and the top wall W2, and surrounds the belt 53 substantially entirely in a horizontal plane. Since the internal wall $W_i$ having the height equal to the height of the belt chamber 63 and surrounds the belt 53 substantially entirely, the belt 53 is prevented from being excessively exposed to the oil-containing gas.

A vertical internal combustion engine E in a second embodiment of the present invention will be described with reference to FIG. 6. The internal combustion engine E in the second embodiment differs only in a transmission case 60 included therein from the internal combustion engine E in the first embodiment and is basically identical in construction with the internal combustion engine E in the first embodiment. Therefore, parts of the internal combustion engine E in the second embodiment like or corresponding to those of the internal combustion engine E in the first embodiment are designated by the same reference characters and the description thereof will be omitted.

Figure 6:
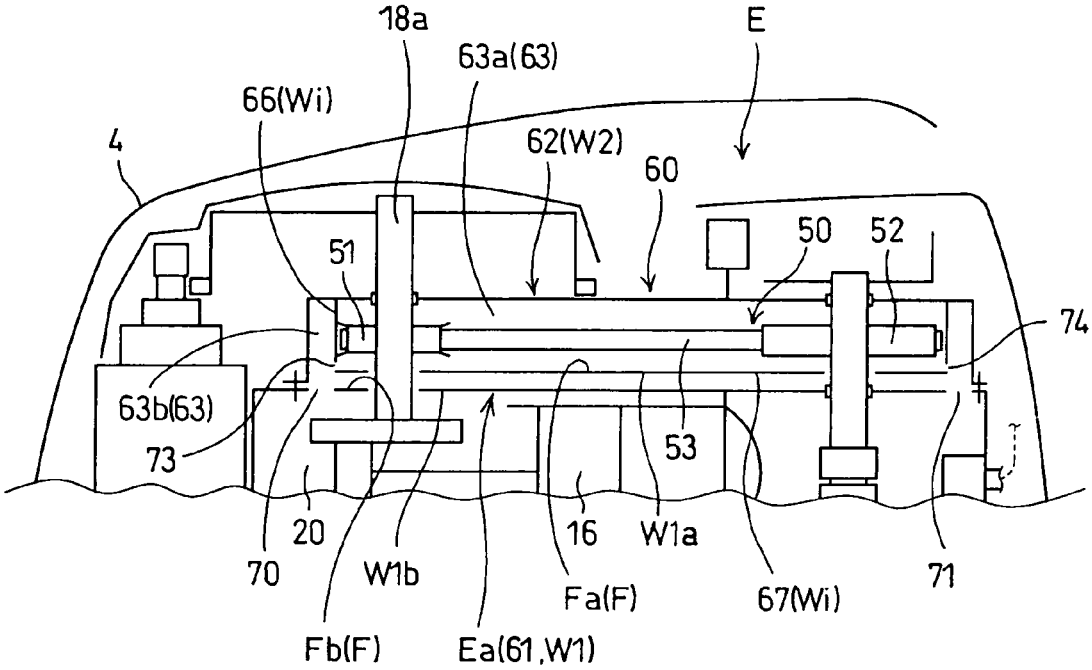
FIG. 6 is a schematic sectional view of a vertical internal combustion engine in a second embodiment of the present invention taken from the left side of the outboard motor.

Referring to FIG. 6, the transmission case 60 defining a belt chamber 63 has a lower case 61 (bottom wall W1) and an upper case 62. An upper end wall $E_a$ of the engine body of the internal combustion engine E serves also as the lower case 61. The upper case 62 is joined to the upper end part $E_a$. An internal wall $W_i$ has a side wall 66 substantially entirely surrounding a transmission mechanism 50 including a belt 53 with respect to a horizontal direction, and an intermediate wall 67 horizontally extending from the lower end of the side wall 66 in the shape of a flat plate. The side wall 66 and the intermediate wall 67 are formed in a unitary member or are made separately and joined together. At least the intermediate wall 67 of the internal wall $W_i$ may be fastened to the upper end part $E_a$ with bolts.

In the second embodiment, the upper end part $E_a$, namely, an outer bottom wall, and the intermediate wall 67, namely, inner bottom wall form a bottom wall W1 defining the bottom of a belt chamber 63, and the upper case 62 forms a top wall W2 defining the top of the belt chamber 63. The internal wall $W_i$ divides the belt chamber 63 into an inner chamber 63*a* in which the transmission mechanism 50 is installed, and an outer chamber 63*b* into which vent holes 70 and 71 open. The side wall 66 is provided with connecting pores 73 and 74. The internal wall $W_i$ having an inside part W1*a* forming the inner chamber 63*a* is at a high level higher than a low level at which the upper end part $E_a$ having an outside part W1*b* forming the outer chamber 63*a* extends An oil-containing gas from a crank chamber 20 flows through the vent hole 70 into the outer chamber 63*b*, hits against and is defected by the internal wall $W_i$, and flows through the connecting port 73 into the inner chamber 63*a*. Oil mist contained in the oil-containing gas wets the belt 53 and pulleys 51 and 52 for lubrication.

An inner bottom surface $F_a$ of the intermediate wall 67 extending in the inner chamber 63*a* and including first part, which corresponds to the first part $F_{a1}$ of the first embodiment, of the inside surface F of the bottom wall W1 extending in the belt chamber 63 is at a high level higher than a low level at which an outer bottom surface $F_b$ including the upper surface of upper end part $E_a$ provided with the vent holes 70 and 71 and extending in the outer chamber 63*b*. The first part, similarly to the first part of the first embodiment, is at a high level higher than a low level at which a second part corresponding to the second part $F_{a2}$ of the first embodiment extending from the first part to the vent holes 70 and 71.

The second embodiment is the same in operations and effects as the first embodiment.

Embodiments in modifications of the foregoing embodiments will be described.

In a modification, the lower case 61 (the bottom wall W1) may be the upper end part $E_a$ of the engine body, and the lower case 62 may be joined to the upper end part $E_a$ to form the belt chamber 63. Since the upper end part $E_a$ serves also as the lower case 61, the number of component parts can be reduced, and the vertical dimension of the internal combustion engine can be reduced.

The internal wall $W_i$ excluding parts provided with the connecting pores 73 and 74 may surround the transmission mechanism 50 entirely with respect to a horizontal direction.

The driven device may be an auxiliary device, such as a rotary oil pump 29 or other transmission mechanism.

A flywheel may be mounted on a lower end part 18*b* of the crankshaft 18 and the drive shaft 5 may be connected to the crankshaft 18 by the flywheel.

The belt chamber 63 may be disposed inside the engine body or may be disposed under the engine body instead of being disposed above the engine body.

The vertical internal combustion engine may be a single-cylinder internal combustion engine and may be incorporated into a machine other than the outboard motor.

What is claimed is:

1. A vertical internal combustion engine comprising:

a hollow crankcase having a crank chamber formed therein;

a transmission case attached to the crankcase and having a belt chamber formed therein;

a valve train chamber disposed below the transmission case;

a crankshaft enclosed in the crank chamber and oriented with a center axis thereof substantially vertically extended;

a driven mechanism including a driven shaft which is rotatively driven by the crankshaft, said driven shaft disposed within the valve train chamber; and a belt-drive transmission mechanism held in a belt chamber and including a flexible belt comprising rubber for transmitting power of the crankshaft to the driven shaft and lubricated with oil;

wherein the belt chamber communicates with the crank chamber by way of vent holes, the transmission case is provided with a barrier member disposed between the vent holes and the belt in the belt chamber so as to deflect a flow of an oil-containing gas flowing from the crank chamber into the belt chamber such that the oil-containing gas flows in directions deviating from a direction toward the belt;

wherein the oil-containing gas flows between the crank chamber and the belt chamber substantially only through a first set of vent holes, and the gas flows between the valve train chamber and the belt chamber substantially only through a second set of vent holes.

2. The vertical internal combustion engine according to claim 1, wherein the vent holes are formed in a bottom wall of the belt chamber, and wherein a first part, extending immediately under the belt, of an inside surface of the bottom wall exposed to the belt chamber is at a high level higher than a low level at which a second part, extending from the first part to the vent holes formed in the inside surface of the bottom wall.

3. The vertical internal combustion engine according to claim 1, wherein the belt chamber has a top wall, and the barrier member extends between the bottom wall and the top wall, has a height equal to a distance between bottom wall and the top wall and extends horizontally so as to surround the belt substantially entirely.

4. The vertical internal combustion engine according to claim 3, wherein the vent holes are formed in parts of the bottom wall of the outer chamber extending outside the barrier member.

5. The vertical internal combustion engine according to claim 1, wherein the first and second vent holes do not overlap the belt drive mechanism in a horizontal plane and lie below the belt.

6. The vertical internal combustion engine according to claim 1, wherein the transmission case includes a lower case which acts as a partition wall substantially entirely isolating an overlying part of the belt drive mechanism.

7. The vertical internal combustion engine according to claim 6, wherein the oil drops in the crank chamber are blocked or partitioned by the lower case such that the oil drops are restrained from adhering to the transmission mechanism including the belt.

8. The vertical internal combustion engine according to claim 7, wherein when the oil-containing gas hits the lower case, part of the oil contained in the oil-containing gas separates from the oil containing gas and adheres to the lower case such that the oil content of the oil-containing gas is reduced.

9. The vertical internal combustion engine according to claim 1, wherein the flow of oil-containing gas is deflected such that the oil containing gas flows in directions deviating from a direction toward the belt chamber and then flows through the first vent holes into the belt chamber.

10. A vertical internal combustion engine comprising:

a crankshaft enclosed in a crank chamber with a center axis thereof vertically extended;

a driven mechanism including a driven shaft rotatively driven by the crankshaft;

a belt-drive transmission mechanism held in a belt chamber and including a belt made of rubber for transmitting power of the crankshaft to the driven shaft and lubricated with oil; and a transmission case defining the belt chamber:

wherein the belt chamber communicates with the crank chamber by way of vent holes, the transmission case is provided with a barrier member disposed between the vent holes and the belt in the belt chamber so as to deflect a flow of an oil-containing gas flowing from the crank chamber into the belt chamber such that the oil-containing gas flows in directions deviating from a direction toward the belt;

wherein the belt chamber has a top wall, and the barrier member extends between the bottom wall and the top wall, has a height equal to a distance between bottom wall and the top wall and extends horizontally so as to surround the belt substantially entirely;

and wherein the bottom wall forming an inner chamber surrounded by the barrier member is at a level higher than a level at which the bottom wall forming an outer chamber outside the barrier member extends.

11. A vertical internal combustion engine comprising:

a crankshaft enclosed in a crank chamber with a center axis thereof vertically extended;

a driven mechanism including a driven shaft rotatively driven by the crankshaft;

a belt-drive transmission mechanism held in a belt chamber and including a belt made of rubber for transmitting power of the crankshaft to the driven shaft and lubricated with oil; and a transmission case defining the belt chamber:

wherein the belt chamber communicates with the crank chamber by way of vent holes, the transmission case is provided with a barrier member disposed between the vent holes and the belt in the belt chamber so as to deflect a flow of an oil-containing gas flowing from the crank chamber into the belt chamber such that the oil-containing gas flows in directions deviating from a direction toward the belt;

wherein the belt chamber has a top wall, and the barrier member extends between the bottom wall and the top wall, has a height equal to a distance between bottom wall and the top wall and extends horizontally so as to surround the belt substantially entirely;

and wherein the barrier member is provided with connecting ports by way of which the inner chamber on the inner side of the barrier member and the outer chamber on the outer side of the barrier member communicate with each other.

12. A vertical internal combustion engine comprising:

a crankshaft enclosed in a crank chamber with a center axis thereof vertically extended;

a driven mechanism including a driven shaft rotatively driven by the crankshaft;

a belt-drive transmission mechanism held in a belt chamber and including a belt made of rubber for transmitting power of the crankshaft to the driven shaft and lubricated with oil; and a transmission case defining the belt chamber:

wherein the belt chamber communicates with the crank chamber by way of vent holes, the transmission case is provided with a barrier member disposed between the vent holes and the belt in the belt chamber so as to deflect a flow of an oil-containing gas flowing from the crank chamber into the belt chamber such that the oil-containing gas flows in directions deviating from a direction toward the belt;

and wherein the vent holes are formed in a bottom wall of the belt chamber, a first part, extending immediately under the belt, of an inside surface of the bottom wall exposed to the belt chamber is at a high level higher than a low level at which a second part, extending from the first part to the vent holes formed in the inside surface of the bottom wall.

13. A vertical internal combustion engine comprising:

a crankshaft enclosed in a crank chamber with a center axis thereof vertically extended;

a driven mechanism including a driven shaft rotatively driven by the crankshaft;

a belt-drive transmission mechanism held in a belt chamber and including a belt made of rubber for transmitting power of the crankshaft to the driven shaft and lubricated with oil; and a transmission case defining the belt chamber:

wherein the belt chamber communicates with the crank chamber by way of vent holes, the transmission case is provided with a barrier member disposed between the vent holes and the belt in the belt chamber so as to deflect a flow of an oil-containing gas flowing from the crank chamber into the belt chamber such that the oil-containing gas flows in directions deviating from a direction toward the belt;

wherein the belt chamber has a top wall, and the barrier member extends between the bottom wall and the top wall, has a height equal to a distance between bottom wall and the top wall and extends horizontally so as to surround the belt substantially entirely;

and wherein the transmission case includes an internal wall disposed in the belt chamber so as to separate the transmission mechanism from the first and second vent holes, isolating the belt chamber from the crank chamber.

14. The vertical internal combustion engine according to claim 13, wherein the internal wall has a height equal to the vertical distance between the bottom wall and the top wall defining the belt chamber.

15. The vertical internal combustion engine according to claim 14, wherein the belt chamber comprises a dual chamber including an inner chamber extending on the inner side of the internal wall and an outer chamber into which the first and second vent holes open.

16. The vertical internal combustion engine according to claim 15, wherein the internal wall is provided with a plurality of connecting ports which connect the inner and outer chambers.

17. The vertical internal combustion engine according to claim 16, wherein the connecting ports comprise first and second connecting ports, each connecting port comprising a pair of slits formed in an internal side wall.

18. The vertical internal combustion engine according to claim 17, wherein part of the oil-containing gas deflected by the internal side wall flows through the first connecting port into the inner chamber, lubricating the belt.

* * * * *